US012330854B2

(12) United States Patent
Lee, Sr. et al.

(10) Patent No.: US 12,330,854 B2
(45) Date of Patent: Jun. 17, 2025

(54) SYSTEMS AND METHODS FOR MAINTAINING TEMPERATURE CONTROL OF ITEMS IN A DISTRIBUTION NETWORK

(71) Applicant: United States Postal Service, Washington, DC (US)

(72) Inventors: James Edward Lee, Sr., St. Leonard, MD (US); Ryan M. Luckay, Vienna, VA (US); Robert E. Dixon, Jr., Haymarket, VA (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 17/655,970

(22) Filed: Mar. 22, 2022

(65) Prior Publication Data

US 2022/0212852 A1 Jul. 7, 2022

Related U.S. Application Data

(63) Continuation of application No. 15/977,198, filed on May 11, 2018, now Pat. No. 11,975,907.

(60) Provisional application No. 62/641,840, filed on Mar. 12, 2018, provisional application No. 62/504,974, filed on May 11, 2017.

(51) Int. Cl.

| | |
|---|---|
| ***B65D 81/18*** | (2006.01) |
| ***B65D 81/38*** | (2006.01) |
| ***F24V 30/00*** | (2018.01) |
| ***F25D 3/06*** | (2006.01) |
| ***F25D 31/00*** | (2006.01) |

(52) U.S. Cl.

CPC ..... *B65D 81/18* (2013.01); *B65D 81/3816* (2013.01); *B65D 81/3823* (2013.01); *F24V 30/00* (2018.05); *F25D 3/06* (2013.01); *F25D 31/005* (2013.01); *F25D 2303/082* (2013.01); *F25D 2303/0843* (2013.01)

(58) Field of Classification Search

CPC ..... B65S 81/18; F25D 5/02; F25D 11/006; F25D 11/003; F25D 3/08; F25D 29/003; F25D 11/02; F28D 20/003; C09K 5/14; C09K 5/16; C09K 5/18; F24V 30/00; B60H 1/00771; G01G 1/207; B65D 81/38; B65D 81/18

See application file for complete search history.

(56) References Cited

U.S. PATENT DOCUMENTS 4,468,913 A 9/1984 Guillon et al.
5,441,170 A 8/1995 Bane, III
(Continued)

FOREIGN PATENT DOCUMENTS

JP 2004272752 A * 9/2004 ..... B60H 1/00771
WO WO 2014/207250 A1 12/2014

*Primary Examiner* — Jianying C Atkisson
*Assistant Examiner* — For K Ling
(74) *Attorney, Agent, or Firm* — Knobbe, Martens, Olson & Bear, LLP

(57) ABSTRACT

A device, system, and method for maintaining temperature control of a distribution item, or of the contents of a distribution item, as the distribution item moves through the distribution network. A container housing an item can include a cooling unit, a heating unit, or both, and control circuitry including a temperature sensor. The control circuitry activates the cooling unit or heating unit as required to maintain the item at a desired temperature or within a desired temperature range.

19 Claims, 10 Drawing Sheets

(56) References Cited

U.S. PATENT DOCUMENTS 5,658,607 A * 8/1997 Herdeman ..... A23B 7/148 426/419
5,899,088 A 5/1999 Purdum
5,917,433 A * 6/1999 Keillor ..... G08G 1/20 340/7.37
5,943,876 A 8/1999 Meyer et al.
6,325,281 B1 12/2001 Grogan
6,763,677 B1 * 7/2004 Burchill ..... F25D 17/045 62/176.1
6,862,499 B1 * 3/2005 Cretella ..... F25D 29/003 700/299
8,402,772 B1 3/2013 Duval et al.
8,763,423 B2 7/2014 Tattam
8,763,886 B2 7/2014 Hall
8,881,540 B1 * 11/2014 Barakat ..... G06Q 10/0832 62/157
9,180,998 B2 11/2015 Banks et al.
9,284,088 B2 3/2016 Humphries et al.
2004/0226309 A1 11/2004 Broussard
2007/0040647 A1 * 2/2007 Saenz ..... H04W 4/40 340/3.1
2007/0193297 A1 8/2007 Wilson
2009/0228155 A1 * 9/2009 Slifkin ..... B60H 1/3232 700/299
2009/0248218 A1 * 10/2009 Dyrmose ..... F25D 29/003 700/300
2009/0299534 A1 * 12/2009 Ludwig ..... F25D 29/003 700/278
2011/0067852 A1 3/2011 Farrar
2011/0221573 A1 * 9/2011 Huat ..... F25D 29/003 340/10.1
2011/0247350 A1 * 10/2011 Awwad ..... F25B 27/00 62/323.3
2012/0000212 A1 * 1/2012 Sanders ..... F25D 29/003 236/51
2012/0210677 A1 8/2012 Proskin
2013/0020309 A1 1/2013 Tattam et al.
2013/0048647 A1 * 2/2013 Farrar ..... B65D 88/745 165/104.34
2013/0247598 A1 * 9/2013 Fulmer ..... B60H 1/3225 62/80
2013/0271290 A1 * 10/2013 Saenz ..... G05D 27/02 340/870.07
2015/0045763 A1 2/2015 Barone, Jr. et al.
2015/0183292 A1 * 7/2015 Muralidhar ..... B60H 1/3211 62/133
2015/0291005 A1 * 10/2015 Olaleye ..... B60H 1/00428 702/183
2015/0308727 A1 10/2015 Iwamoto
2016/0180629 A1 6/2016 Chapman et al.
2016/0185183 A1 6/2016 Crombie et al.
2016/0280040 A1 * 9/2016 Connell ..... G05D 23/1905

* cited by examiner

SYSTEMS AND METHODS FOR MAINTAINING TEMPERATURE CONTROL OF ITEMS IN A DISTRIBUTION NETWORK

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a Continuation application of U.S. application Ser. No. 15/977,198, filed May 11, 2018, which claims the benefit of priority to U.S. Provisional Applications Nos. 62/641,840 filed Mar. 12, 2018 and 62/504,974, filed May 11, 2017, the entire contents of which are hereby incorporated by reference.

BACKGROUND

Field

The present disclosure relates to a systems and methods to maintain a desired temperature within a container.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION

Figure 1A:
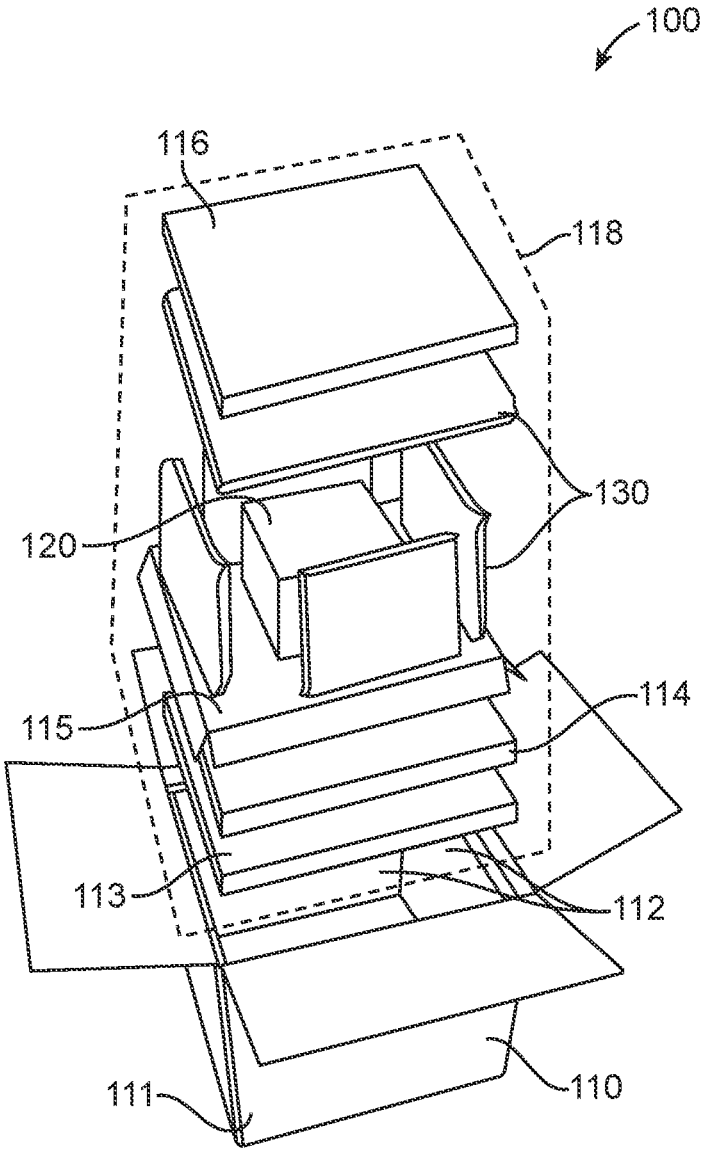
FIG. 1A is an exploded view of an embodiment of a system for shipping an item in a temperature controlled environment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Reference in the specification to "one embodiment," "an embodiment", or "in some embodiments" means that a particular feature, structure, or characteristic described in connection with the embodiment is included in at least one embodiment of the invention. Moreover, the appearance of these or similar phrases throughout the specification does not necessarily mean that these phrases all refer to the same embodiment, nor are separate or alternative embodiments necessarily mutually exclusive. Various features are described herein which may be exhibited by some embodiments and not by others. Similarly, various requirements are described which may be requirements for some embodiments but may not be requirements for other embodiments.

As used herein, an item can be a parcel, a package, an envelope, a flat, a mailpiece, a box, a suitcase, a pallet, a load, a bag, a hamper, or any other object or container that can be transported from one location to another by a distribution entity. Also, as used herein, an item can be the object being transported within a box, suitcase, package, parcel, and the like. A distribution entity may be an entity engaged in transporting items from one location to another, such as the United States Postal Service (USPS), another commercial carrier, a storage facility, a fulfillment warehouse, a luggage sorting facility, or any other similar facility, company, or entity.

Many items are purchased online and need to be shipped. Some of these items need to be maintained below a specific temperature, above a specific temperature, or within a specific temperature band. For example, perishable items, medicines, or items with a relatively low melting point or freezing point, may become damaged, spoiled, rotten, unusable, or even dangerous if the temperature of the item is not properly maintained during shipping or transit.

Described herein are systems and methods for maintaining temperature control within a container for shipping an item.

FIG. 1A is an exploded perspective view of an embodiment of a temperature controlled shipment system 100. The shipment system 100 is used to package an item 120 for transportation from one point to another, with elements of the shipment system 100 providing a temperature controlled environment for the item 120. The shipment system 100 comprises a container 110, various insulation and support layers which will be described below, and one or more temperature control packs 130. The container 110 receives, encloses, or holds all the other components of shipment system 100. The container 110 may be made of a rigid material, such as corrugated paper, cardboard, Styrofoam, plastic, wood, metal, or any other suitable material. The material of the container 110 can have a coating or multiple coatings applied thereto which can provide additional insulation for hot or cold applications, for protection against condensation and/or moister, and the like. The container 110 is coated with a reflective layer 111, which is a reflective coating added to the container 110 to reflect radiation, such as sunlight, and mitigate the heating effects of solar radiation. In some embodiments, the reflective layer 111 can be applied to the inner surface of the container 110.

An insulating liner 112 is disposed within the container 110. The insulating liner can be made of an insulating material, and can be attached to the inner surfaces of the container, or can be slidably inserted and/or removed from the container. In some embodiments, the insulating liner can be a honeycomb-type paper arrangement having either air or another insulating material in the spaces in the honeycomb matrix. The insulating liner 112 can include, but is not limited to, polyurethane foam, beaded polystyrene foam, or extruded polystyrene foam. In some embodiments, the insulating liner 112 can be a fiber-type insulation, or can be any other desired insulating material. Advantageously, the insulating liner 112 can be formed from a lightweight material to keep the overall weight of the shipping system 100 low. In some embodiments, the insulating layer 112 is coated with a water resistant coating.

An insulating base 113 is inserted into the container 110. The insulating base 113 can be formed of the same material as the insulating liner 112, or can be formed of a different material. In some embodiments, the insulating base 113 can be a single component, such as a piece of honeycomb-type insulation. In some embodiments, the insulating base 113 can be a loose foam layer, such as insulating packing peanuts.

A cooling layer 114 can be placed on the insulating base 113. The cooling layer 114 can comprise an ice pack, dry ice, or other similar cooling material. In some embodiments, the cooling layer 114 can be a temperature control pack 130 as will be described in greater detail below. In some embodiments, the cooling layer 114 can be omitted. In some embodiments, the cooling layer 114 can be replaced with a layer of insulating foam material, such as packing peanuts.

A support layer 115 is placed on the cooling layer 114, or is placed on the insulating base 113. The support layer 115 can be a rigid material, and is adapted to provide a stable platform on which to place the item 120. The support layer 115 can be a cardboard platform, a plastic tray-like insert, or any other suitable material. The support layer 115 provides a planar surface on which to place the item 120. In some embodiments, the support layer 115 can comprise a preformed shape or outline of a specific item 120 to be shipped formed therein. For example, the support layer 115 can be a foam layer having the outline, indentation, impression, or shape of a specific product to be shipped, so that the product will be retained in a desired position.

The item 120 is placed on the support layer 115. One or more temperature control packs 130 are placed around the item 120. In some embodiments, the one or more temperature control packs 130 comprise an ice pack, a cold pack, and/or a hot pack. The one or more temperature control packs 130 will be described in greater detail below.

A top insulating layer 116 is placed on the item 120, or on a top temperature control pack 130. The assembly including the insulating base 113, the cooling layer 114 (if present), the support layer 15, the one or more temperature control packs 130, and the top insulating layer 116 are disposed within a wrapper 118. The wrapper 118 can be a plastic sheath, a bag, shrink wrap, or other similar material. The wrapper 118 can keep any condensation or moisture developed from the one or more temperature control packs 130 contained within the wrapper 118, which can maintain the integrity of the container 110 and help maintain the temperature within the wrapper 118. In some embodiments, the shipment system 100 does not include a wrapper 118.

Figure 1B:
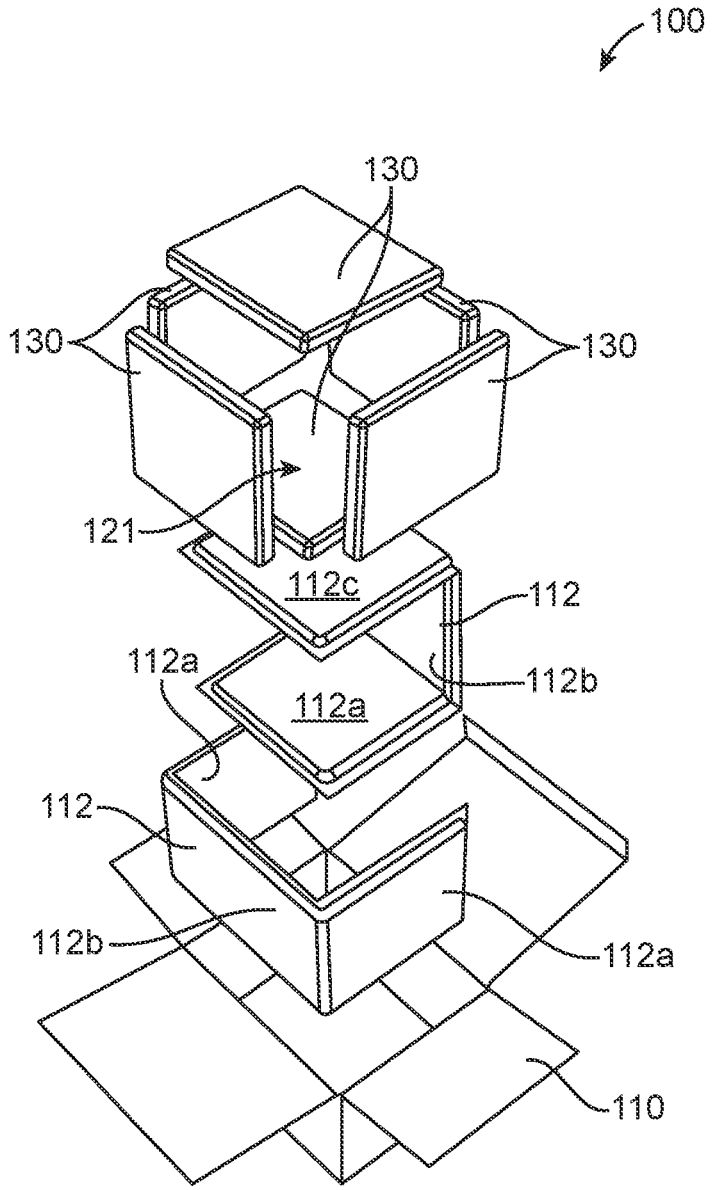
FIG. 1B is an exploded view an embodiment of a system for shipping an item in a temperature controlled environment.

FIG. 1B is an exploded perspective view of an embodiment of the temperature controlled shipment system 100. The shipment system 100 is used to package an item for transportation from one point to another within a payload space 121. The shipment system 100 includes elements that provide a temperature controlled environment for an item within the payload space 121. The shipment system 100 comprises a container 110, insulation wraps 112, and one or more temperature control packs 130. The container 110 receives, encloses, or holds all the other components of shipment system 100 and may be similar to those described elsewhere herein. The container 110 may be made of a rigid material, such as corrugated paper, cardboard, Styrofoam, plastic, wood, metal, or any other suitable material. The container 110 can include a coating such as a moisture barrier coating on the internal surfaces of the container 110.

The insulation wraps 112 are disposed within an internal volume of the container 110. As shown, the insulation wraps 112 are "C-wraps", meaning they are shaped like the letter "C". Each of the insulation wraps 112 has three sections, 112*a*, 112*b*, and 112*c* which form a "C". Using two insulation wraps 112 can provide coverage on all six sides of an item within the payload space 121 when they are placed within the container 110, as will be described in greater detail hereafter.

The sections 112*a*, 112*b*, and 112*c* can be moveably joined together, or can be formed of a single piece with score lines or other features to allow the sections 112*a*, 112*b*, and 112*c* to move relative to each other. The insulation wraps 112 can comprise a paper outer layer, such as a paper envelope, a corrugated material, or other similar material. The insulation wraps 112 can include a water repellant or high thermal conductivity coating, or a heat-seal coating on one or more sides or faces. In some embodiments, the insulation wraps 112 can be filled with a fiber insulation. In some embodiments, the fiber insulation can be recyclable and/or biodegradable. In some embodiments, two insulation wraps 112 can be inserted into the container 110 in different orientations, such that the "C" shapes interlock, as depicted in FIG. 1B.

The temperature control packs 130 can be similar to those described elsewhere herein. In some embodiments, the temperature control packs 130 can be gel filled packs contained in foil bubble wrap. The temperature control packs 130 can be placed on one, more than one, or surrounding all sides of the payload space 121. In some embodiments, the temperature control packs 130 need not surround all sides of the payload space 122, but can be disposed on only 1 side, top, or bottom, can be disposed on opposite sides, adjacent sides. In some embodiments, there can be 4 temperature control packs arranged around a perimeter of the payload space 121.

An item can be placed into the payload space 121, where it will be enclosed, bordered, or surrounded by one or more temperature control packs 130. The payload space 121 and the surrounding temperature control packs 130 can be placed into a void formed by the interlocking "C" shapes of the insulation wraps 112. The insulation wraps 112 enclosing the temperature control packs 130 and the payload space 121 can be placed in the container 110.

In some embodiments, an insulation wrap 112 can be placed in the container 110 in a generally vertical arrangement such that sections 112*a*, 112*b*, and 112*c* are in contact or proximity to the internal sides of the container 110. A second insulation wrap 112 can be placed in the container with section 112*a* in contact with or in proximity to the internal bottom surface of the container 110, section 112*b* is in contact with or in proximity to an internal side of the container 110, and section 112*c* is not in contact with the container. Section 112*c* can be folded up such that it is co-planar or substantially co-planar with section 112*b*. the temperature control pack 130 assembly surrounding the item within the payload space 121 can be placed in the container and in a boundary formed by sections of the insulation wraps 112, such that a bottom portion of the temperature control pack 130 assembly is in contact with the section 112*a* of one of the insulation wraps 112. Section 112*c* of one of the insulation wraps 112 can then be folded over to cover the top of the temperature control pack 130 assembly, and to allow the container 110 to be closed.

In some embodiments, the shipment system 100 can include one or more features depicted in FIG. 1A in combination with one or more features depicted in FIG. 1B. The containers 110 can come in a variety of sizes and shapes. For example, although a generally cube-shaped box is depicted in FIGS. 1A and 1B, a rectangular box or any other shape or size box can be used without departing from the scope of the current disclosure.

Figure 2A:
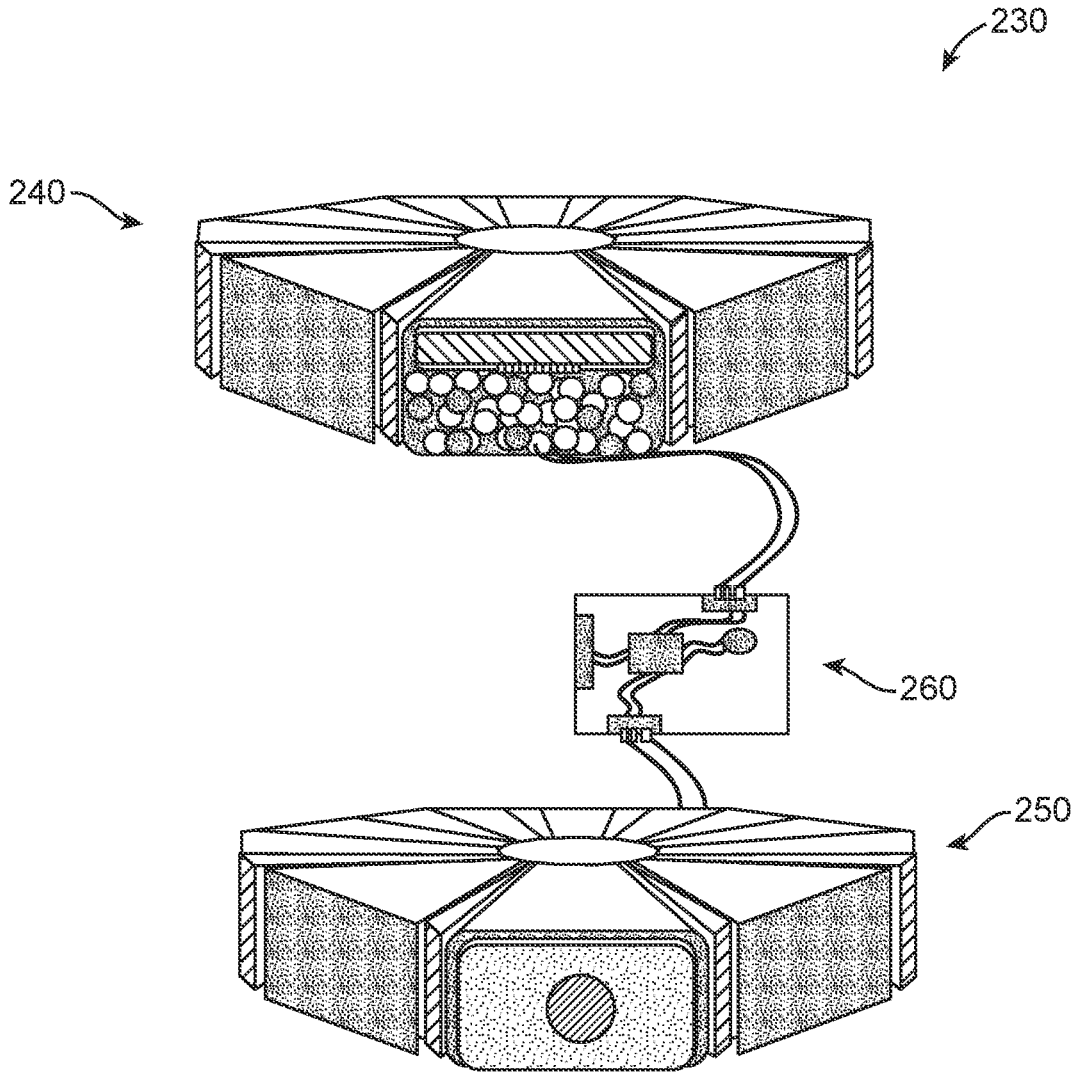
FIG. 2A is a perspective view of an embodiment of a temperature control device.

FIGS. 2A-5 depict embodiments of systems for use in climate control applications, such as those depicted in FIG. 1. FIG. 2A depicts an embodiment of a temperature control pack 230. The temperature control pack 230 can be used in a temperature controlled shipping system 100 described with regard to FIG. 1. In some embodiments, the temperature control pack 230 may be used in a container 110 as one or more of the temperature control packs 130. The temperature control pack 230 comprises a cooling unit 240, a heating unit 250, and control circuitry 260. The temperature control pack 230 can be inserted into a shipping container similar to container 110 at locations or positions similar to those shown in FIG. 1, or in any other desired container or position within the container, and can maintain temperature in a specified range within the container.

For example, using the cooling unit 240 and the heating unit 250, the temperature within a container can be maintained within a certain range, for example within a range of 36° F. to 46° F., which is a desirable range for maintaining drugs, medicines, pharmaceuticals, and the like. The range above is exemplary, and a person of skill in the art will know that the range within which the temperature of an item, or the temperature within a shipping container, can be maintained and can be set to any desired range or temperature setting within the capability of the cooling and heating materials used. Maintaining temperatures of distribution items can be referred to as "Cold Chain" logistics. The operation of the cooling and heating units 240, 250 will be described in greater detail below.

In some embodiments, a temperature control pack 230 can include only a cooling unit 240 and control circuitry 260. In some embodiments, the temperature control pack 230 can include only a heating unit 250 and the control circuitry 260. For example, if an item is shipped from and/or to a warm climate, or if an item is not susceptible to damage from freezing, there may be no concern about ensuring a minimum temperature is maintained within the container. In some embodiments, the cooling unit 240 can be configured such that the cooling unit cannot actually cool the item below a certain threshold, such as a freezing point, and so no heating unit 250 would be necessary.

In some embodiments, the temperature control pack 230 can include only a heating unit 250 and the control circuitry 260 where the item originates in or is sent to a cold climate, and the concern is to keep an item from freezing due to ambient temperatures. In some embodiments, an item may only need to be maintained above a minimum temperature, and there is no concern about the item getting too warm. In this example, only a heating unit 250 would be needed.

Figure 2B:
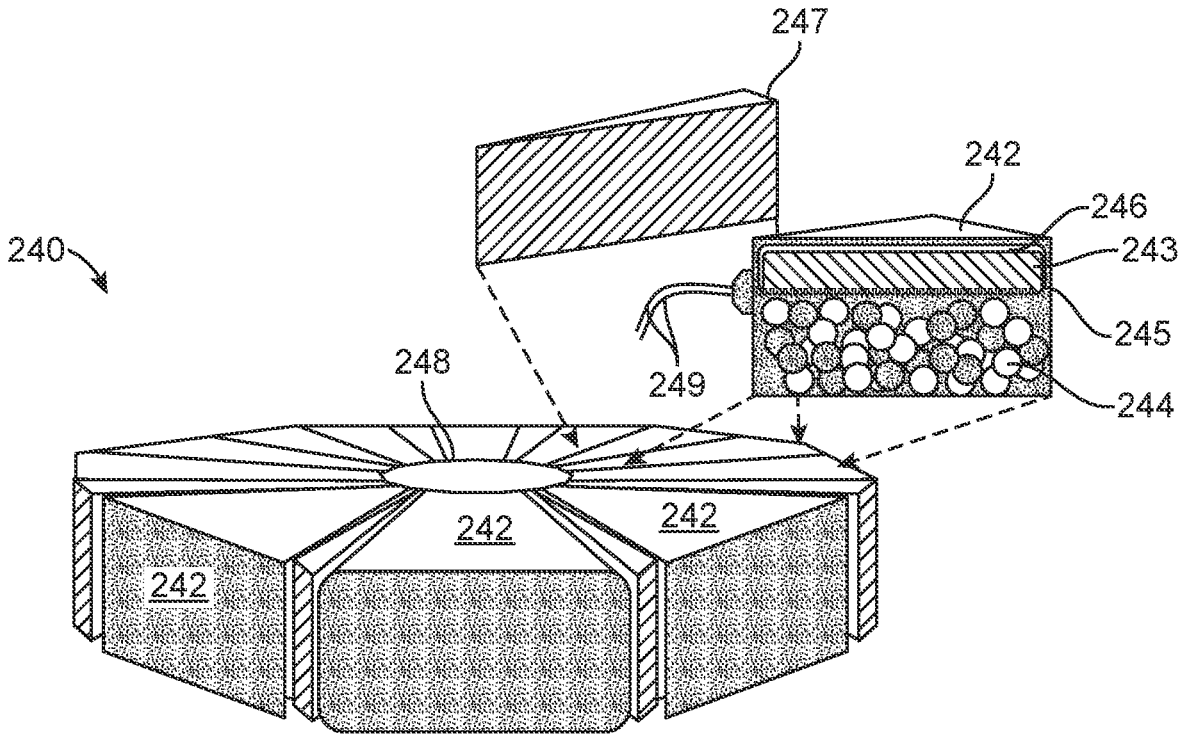
FIG. 2B is a perspective view of an embodiment of a cooling unit in a temperature control device.

FIG. 2B depicts the cooling unit 240 for use in the temperature control pack 230. The cooling unit 240 comprises a plurality of cooling cells 242, a plurality of insulating cells 247, and a switch 248.

The plurality of cooling cells 242 are shown arranged around the central switch 248, like the pieces of a pie. Each of the cooling cells 242 can be activated separate from each of the other cooling cells via the central switch, which will be explained in greater detail below. The depicted geometric embodiment is exemplary only, and any other geometric or physical arrangement of cooling cells 242 can be used without departing from the scope of this disclosure.

The plurality of cooling cells 242 each comprise a first component 243, a second component 244, and a barrier 245, such as an electro-permeable barrier. The first component 243 is contained in a pouch 246, reservoir, or other impervious material which retains the first component 243 and prevents the first component 243 from contacting the second component 244. The second component 244 can be retained within the cooling cell 242, but need not be enclosed within the pouch 246 or other similar material. The barrier 245 is part of the pouch 246 containing the first component 243, and will react physically to the application of an electric current. When an electric current is applied to the barrier 245, portions of the barrier 245 will break, creating gaps or voids in the pouch 246 in which the first component 243 is retained. The barrier 245 may be formed of filaments, fusible links, piezoelectric material, carbon fiber, or other materials. The barrier 245 may be configured to physically move when an electrical current is applied. The barrier 245 may be configured to melt, shorten and break, or otherwise change state or shape to permit an opening for the first component 243 to contact the second component 244.

In some embodiments, the first component 243 is water, pure water, deionized, or distilled water. The water of the first component 243 is contained within the pouch 246. In some embodiments, the second component 244 is ammonium nitrate, calcium ammonium nitrate, or urea. The second component 244 can be present as beads, particles, or in another solid form. Breaking the barrier 245 and creating gaps or voids in the pouch 246 allows the first component 243 to mix with the second component 244. The combination and reaction of the first and second components 243, 244 creates an endothermic reaction, thereby lowering the temperature of the cold pack 242.

The plurality of insulating cells 247 can be made of materials such as thermally resistant foam, metal, or carbon fiber, or any combination of these. The plurality of insulating cells 247 are positioned between individual cooling cells 242 to prevent activation of one cooling cell 242 from damaging an adjacent cooling cell. The plurality of insulating cells 247 also serve to prevent the cooling effect from the cooling cells 242 from affecting neighboring cooling cells in order to direct the cooling effect or the thermal gradient toward the item in the container.

The switch 248 comprises individual leads 249 connected to each of the cooling cells 242. The switch 248 provides an electric signal to a selected one or more of the plurality of cooling cells 242 according to a signal sent from control circuitry 260, as will be described in greater detail below with regard to FIG. 2D. The electrical signal sent along the leads 249 is received by the barrier 245 and causes the barrier 245 to break to initiate the cooling reaction in the cooling cell 242. In some embodiments, the leads 249 can be enclosed in a foil sleeve (not shown) to isolate the leads 249 from electrical interference or noise signals.

In some embodiments, the switch 248 is a bundle of leads which extend from the control circuitry 260 to the individual cooling cells 242. In some embodiments, the switch 248 receives a lead or set of leads from the control circuitry 260, and which can distribute a signal from the control circuitry 260 to one or more of the cooling cells via leads 249 to activate the cooling cells 242 in a pattern or order that one of skill in the art will recognize as effective to maintain the desired temperature or temperature range.

Figure 2C:
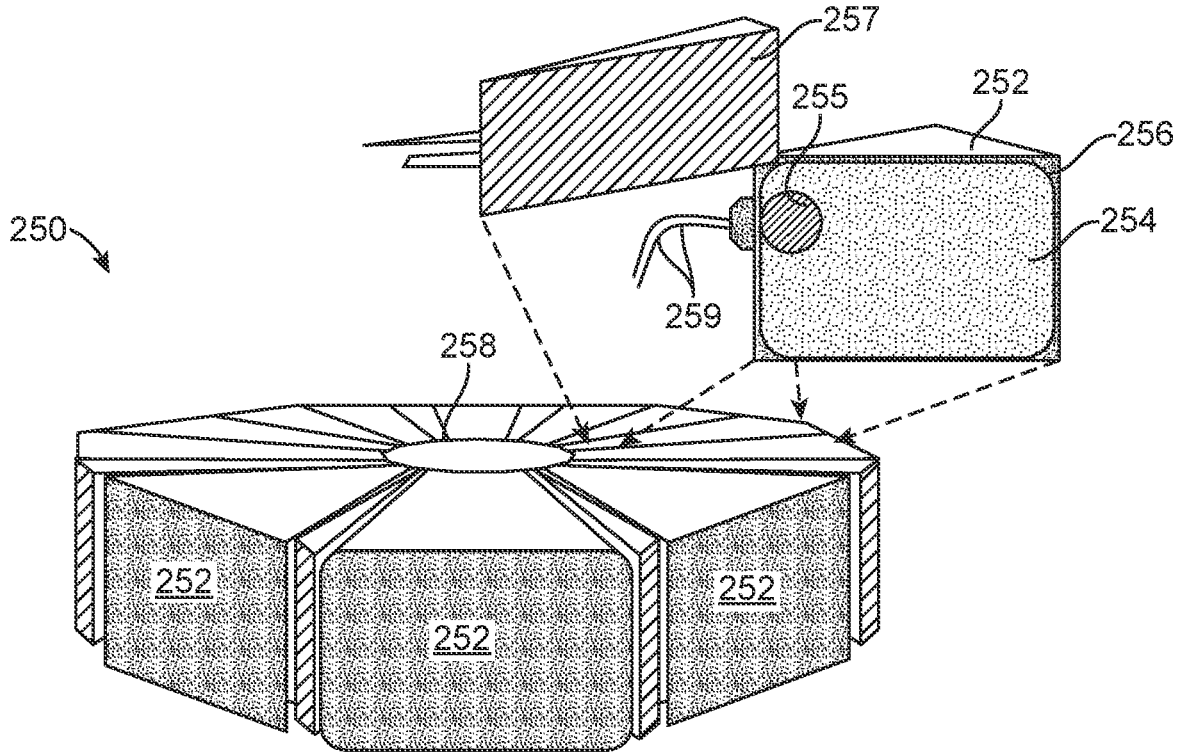
FIG. 2C is a perspective view of an embodiment of a heating unit in a temperature control device.

FIG. 2C depicts the heating unit 250 used in the temperature control pack 230. The heating unit 250 comprises a plurality of heating cells 252, a plurality of insulating cells 257, and a switch 258.

The plurality of heating cells 252 are shown arranged around the central switch 258, like pieces of a pie. Each of the heating cells 252 can be activated independent of the other heating cells 252 via the central switch 258, which will be explained in greater detail below. The depicted geometric embodiment is exemplary only, and any other geometric or physical arrangement of heating cells 252 can be used without departing from the scope of this disclosure.

The plurality of heating cells 252 each comprise a heating solution 254 and an activator 255. The heating solution 254 is contained in a pouch 256, reservoir, or other impervious material. The activator 255 is disposed in the pouch 256 and is in contact with the heating solution 254. The activator 255 will react physically to the application of an electric current. The activator 255 can be a metallic disc, a piezoelectric, or other similar component which reacts physically when an electric current is applied.

In some embodiments, the heating solution 254 can be a supersaturated solution of sodium acetate in water. In some embodiments, the pouch 256 can contain 44 mL of supersaturated sodium acetate solution. Applying an electric current to the activator 255 causes the activator 255 to deform, move, or change shape in order to cause the sodium acetate to crystallize in an exothermic reaction, generating heat in the heating cell 252.

The plurality of insulating cells 257 are positioned between individual heating cells 252 to prevent activation of one heating cell 252 from damaging an adjacent heating cell 252. The insulating cells 257 also serve to prevent the heating effect of the actuated heating cells 252 from affecting neighboring heating cells. This can also direct the heating effect or the thermal gradient toward the item in the container. The plurality of insulating cells 257 can be similar to those described elsewhere herein.

The switch 258 comprises individual leads 259 connected to each of the heating cells 252. The switch 258 can be similar to those described elsewhere herein. The switch 258 provides an electric signal to a selected one or more of the plurality of heating cells 252 according to a signal sent from control circuitry, which will be described in greater detail below. The electrical signal sent along the leads 259 is received at the activator 255 which initiates the heating reaction in the heating cell 252.

Figure 2D:
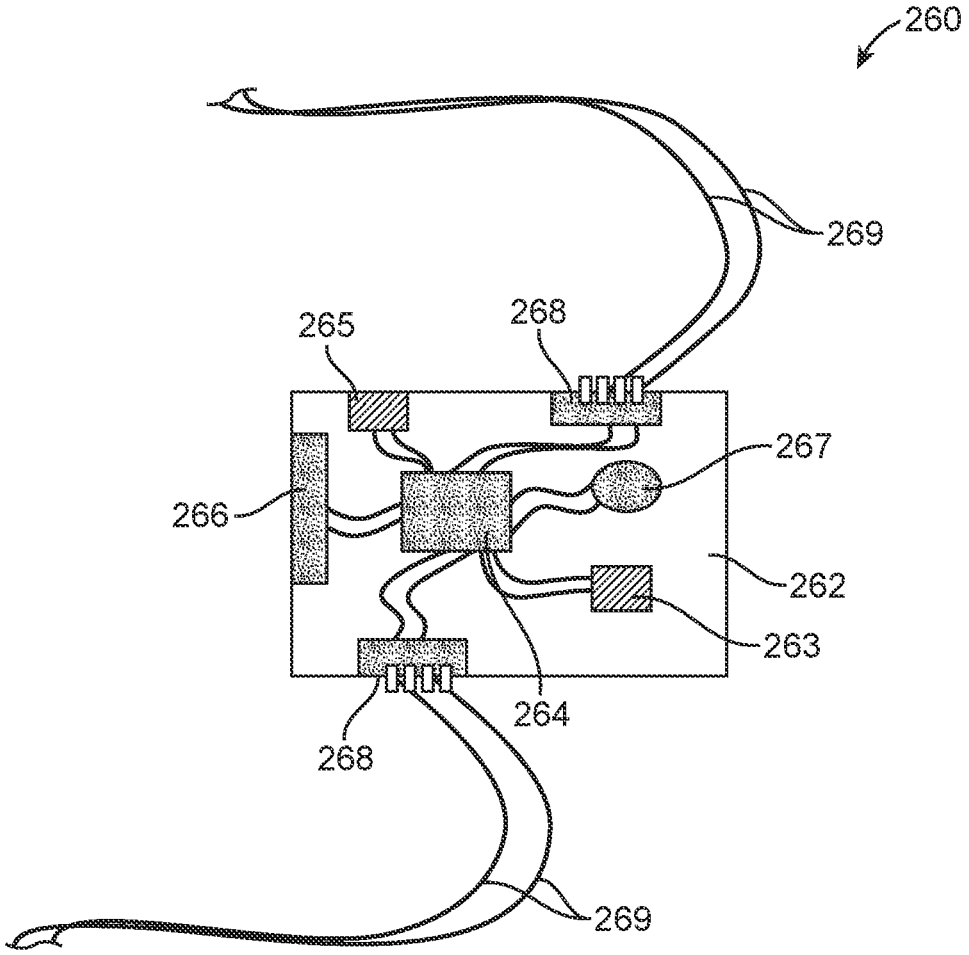
FIG. 2D is a perspective view of an embodiment of control circuit in a temperature control device.

FIG. 2D depicts an embodiment of control circuitry 260 for the temperature control pack 230. The control circuitry 260 comprises a circuit board 262, a processing unit 264, a communications port, a temperature sensor 266, a power source 267, and one or more output terminals 268. The circuit board 262 is a platform on which the other components and electrical wiring between the other components can be placed. The circuit board 262 may comprise an adhesive or similar material to allow the control circuitry 260 to be attached to an inner surface of a container.

The processing unit 264 can be a central processing unit having a processor and on-board memory storing operating instructions for the processor. The processing unit 264 can be a specially manufactured processing unit having specific features and capabilities suited for operation in a temperature controlled environment. The operation of the processing unit 264 will be described in greater detail below.

The temperature sensor 266 detects the temperature within a container in which the temperature sensor 266 is disposed. The temperature sensor can be a negative temperature coefficient (NTC) thermistor, a resistance temperature detector (RTD), a thermocouple, or semiconductor-based temperature sensor. In some embodiments, temperature sensor 266 continuously measures the temperature within the container. In some embodiments, the temperature sensor measures the temperature within the container at set intervals of time. The set intervals of time may be determined based on several factors including, but not limited to, the item being shipped, the length of transport time, life of the power source 267, environmental/ambient temperature of the container, and the like.

In some embodiments, the intervals of time can change based on the location of the container. For example, the communications port can receive a location signal from a device, facility, etc. within the distribution network. The location signal can change the intervals of time or change the temperature range of the item. If a container is being transported from one location to another, the temperature patterns or weather of an intermediate location between the origin and destination of the item can be used as an input to the processor 264. In some embodiments, the communications port 265 can include a location sensing module, using GPS, triangulation, Wi-Fi, cellular, Bluetooth, etc., in order to identify its location. In some embodiments, the communications port can receive signals from processing facility equipment, carrier devices, vehicles, and the like which include current temperature and temperature forecasts. The processor 264 can use this information to determine whether to increase frequency of temperature measurements, reduce frequency of temperature measurements, to expand or contract the set temperature range, and the like. In some embodiments, these signals can be provided by a supervisor's mobile computing device to a container in a facility local to or remote from the supervisor's mobile computing device.

The power source 267 can be a coin cell battery, button cell battery, or another type of battery source of electrical power. The power source 267 is electrically connected to the processing unit 264, the temperature sensor 266, and all the other components of the control circuitry 260. The power source 267 provides a source of electric current to operate the processing unit 264, the temperature sensor 266, and to actuate the cooling and heating units 242, 252.

The output terminals 268 are electrically connected to the processing unit 264 and the power source 267, and transfer current and/or signals from the power source 267 along leads 269 to switches 248 and 258 in the cooling and heating units 242, 252.

The communications port 265 can be a USB, microUSB, or other type of input/output connection protocol. In some embodiments, the communications port 265 can be a wireless communication device using a wireless communication type or protocol, such as cellular, Wi-Fi, Bluetooth, near field communication, LAN, or any other wireless communication protocol or mechanism. The communications port 265 can be used to input instructions to the processing unit 265, for example, regarding temperature set points, or other instruction. The communications port 265 can also be used to retrieve stored data, error messages, or other information regarding the operation of the control circuitry 260. The control circuitry 260 includes an alarm 263. The alarm 263 may be an audible, visual, or other type of alarm, including transmitting alarm indications via the communications port 265 to a mobile computing device. In some embodiments, the communications port 265 and/or the alarm may not be present on the circuit board 262.

In some embodiments, the container 100 can include the control circuitry 260. For example, if the heating and/or cooling units are heating or cooling gel packs which are not electrically activated, there may be control circuitry including the processor 264, the communications port 265, and the communications port 265 in order to communication the temperature of the item 120 and/or alarm conditions within the container to a remote computing device.

Figure 2E:
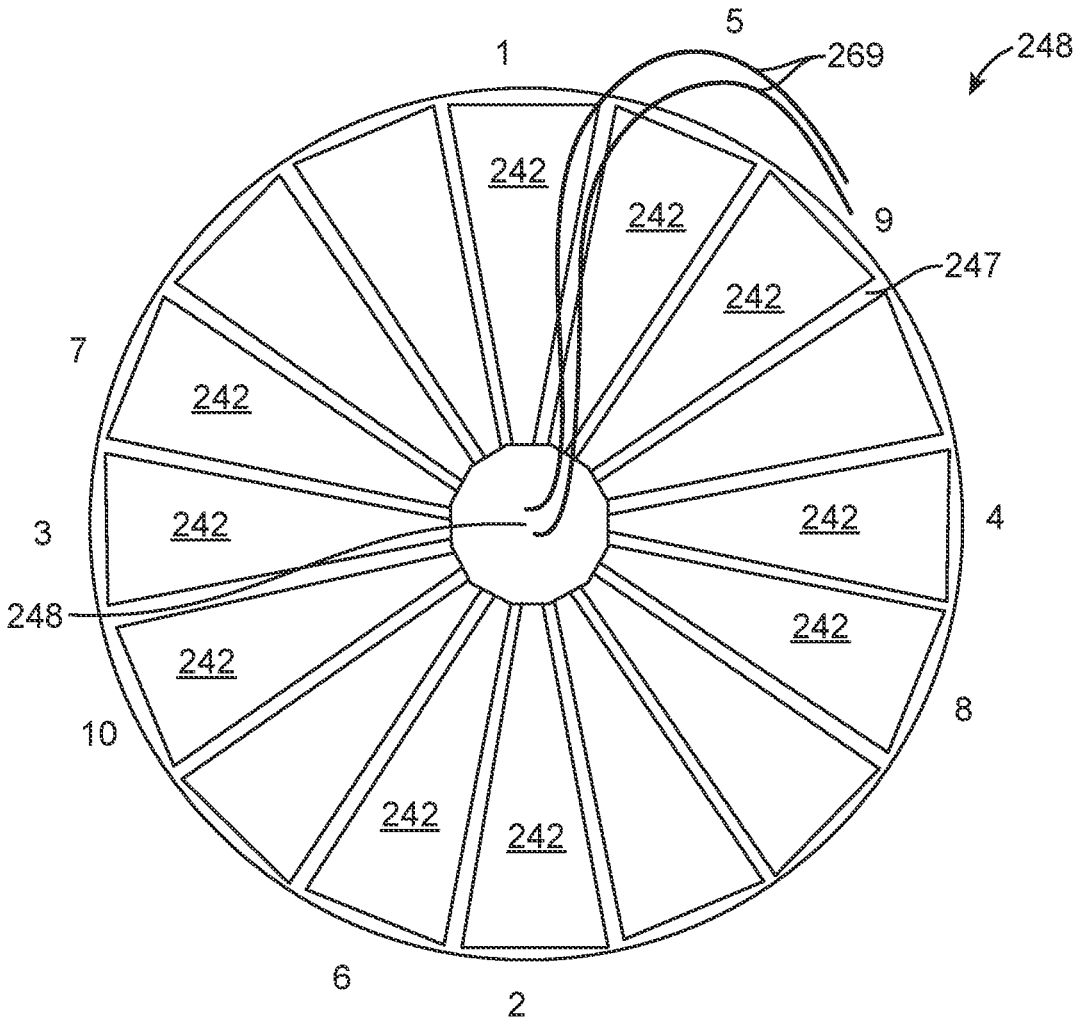
FIG. 2E depicts a simplified top view of an embodiment of a cooling or heating unit.

FIG. 2E is a top view of an embodiment of a heating or cooling unit as described herein. FIG. 2E is described with reference to the cooling unit 240, but this discussion can apply equally to the operation of the heating unit 250 of the temperature control pack 230. The cooling unit 240 is electrically connected to the control circuitry 260 via leads 269. The leads 269 connect to the switch 248. As described elsewhere, the switch is in electrical communication with each of the plurality of cooling cells 242. The switch is configured to activate the cooling cells 242 in a specific pattern in order to apply the most efficient use of thermal energy, and to make the thermal gradient or flux across the item within the container uniform. This can prevent localized low or high temperatures, which may be undesirable in some cases.

As shown, upon a signal to actuate a cooling cell 242 from the processing unit 264, the switch 248 is configured to actuate the cooling cell 242 labeled "1" first (cooling cell 242-1), and then to actuate the cooling cell 242-2 opposite cooling cell 242-1. The switch 248 next actuates cooling cells 242-3, then, in order, 242-4, 242-5, 242-6, 242-7, 242-8, 242-9, 242-10. The process continues following the same pattern for the remaining cooling cells 242 which are not specifically labelled. In some embodiments, the cooling cells 242-1 and cooling cell 242-2 may be actuated in opposing pairs to ensure a temperature gradient or heat flux is created equally across the cooling unit 240. In some embodiments, the cooling cells may be actuated in a trio, such as actuating cooling cells 242-1, 242-10, and 242-8 simultaneously which would provide a more uniform thermal gradient across the item within the container. In some embodiments, adjacent or proximate cooling cells 242 can be actuated together. A person of skill in the art would understand that different patterns or combinations of cooling cells 242 can be actuated to achieve different desired thermal gradients in the item and/or within the container.

Figure 3:
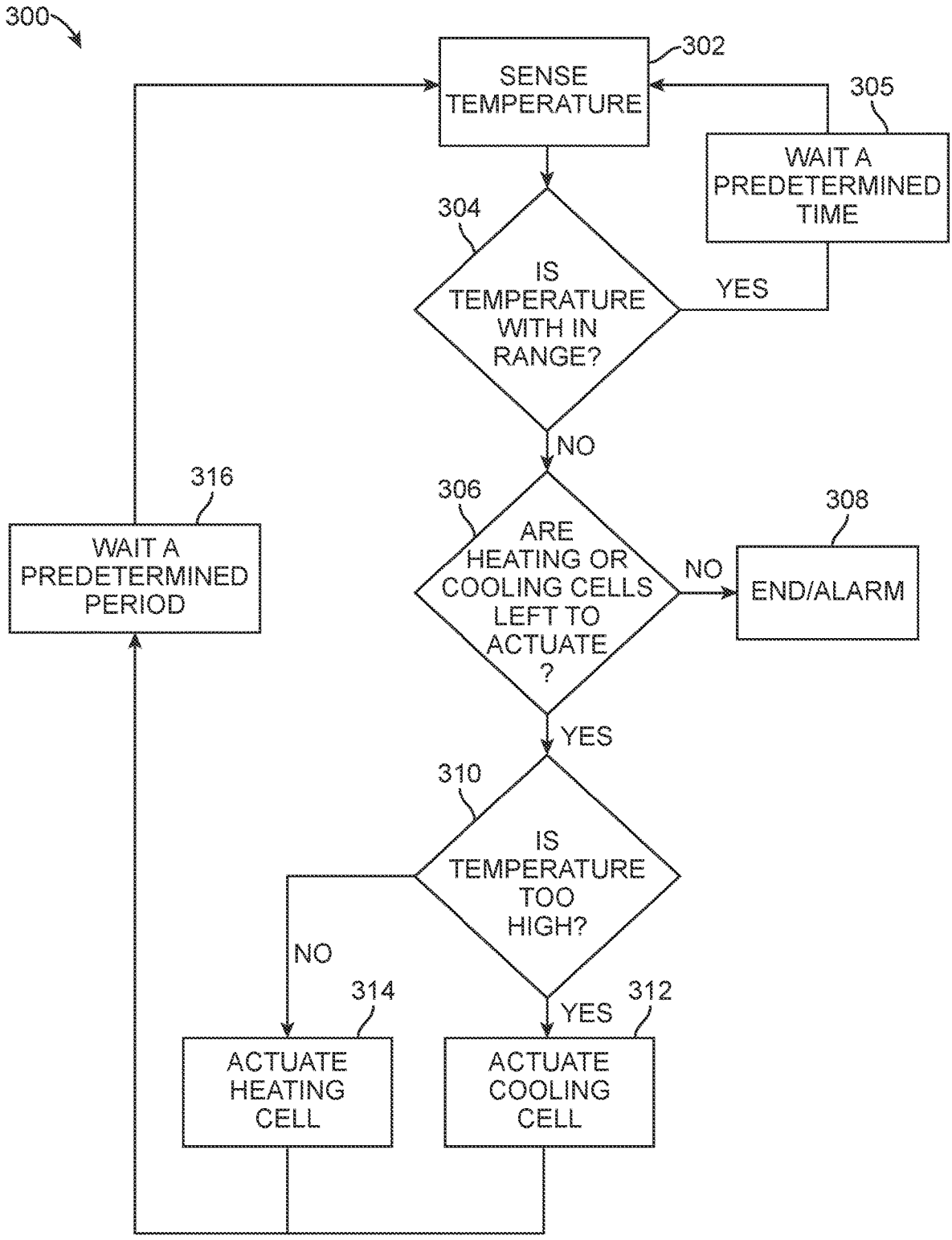
FIG. 3 is a flow diagram of an embodiment of a process for operating a temperature control device.

FIG. 3 is a flow chart depicting an embodiment of a process for maintaining temperature control within a container. The container contains an item to be transported, and which has particular temperature control requirements. A process 300 describes the operation of a temperature control pack 230 installed within a container, such as a box or other type of shipping container.

The process 300 describes operation of a temperature control pack 230 which has been activated. Activation of the temperature control pack 230 can occur upon sealing of the container 110. In some embodiments, the container 110 may include in its closure mechanism electrical contacts which activate the control circuitry 260 when the closure mechanism is activated. In some embodiments, sealing the box may include removing an insulating tab from between the power source 267 and the processor 264, which can activate the temperature control pack 230. For example, this may be similar to those described in U.S. Provisional Application No. 62/442,345, filed Jan. 4, 2017, the entire contents of which are herein incorporated by reference.

In some embodiments, the temperature control pack can be activated by a signal from a computing device to the communications port 265. The activation signal from the computing device can also include a temperature range within which the temperature should be maintained. The activation signal can also include any other desired information or instructions to the temperature control pack 230.

The process 300 begins in step 302, wherein the temperature of the inside of the container is sensed. The temperature sensor 266 senses the temperature in the environment of the container. In some embodiments, the temperature sensor may be in direct contact with the item within the container in order to provide a more accurate temperature reading.

The process 300 moves to decision state 304 wherein it is determined, in the processing unit 264, whether the sensed temperature is within a specified or pre-determined range. As described herein, a temperature can be within the specified or predetermined range when the temperature is at any temperature value between the temperature range endpoints or is at the temperature endpoints. The specified or predetermined temperature range can be based on the characteristics of the item. For example, a drug, medicament, pharmaceutical, biological specimen, or other item may need to be maintained within a specified temperature range to prevent degradation, loss of efficacy, and the like. The predetermined or specified temperature may be based at least in part on the environment or ambient conditions of the origination, destination, or transportation route of the item. For example, where the item is travelling a long distance, the temperature range may be widened to allow for less frequent actuation of heating or cooling cells, 252, 242. Where the item originates in a cold climate, or in the winter, a temperature range may be set to prevent freezing of the item. In some embodiments, the temperature range may have an endpoint only on a single end. For example, the specified or predetermined temperature range may be any temperature≥36° F.

Where an item originates in a hot climate, in the summer, the specified or pre-determined temperature range may be set to prevent an item from heat damage, melting, denaturing, or other heat induced problem. In these situations, the specified or pre-determined temperature range may be any temperature≤80° F. Of course, these temperature values are exemplary only. Further, where the chief concern is preventing too high a temperature, or too low a temperature, the temperature control pack 230 may include only a cooling unit 240 or a heating unit 250.

In some embodiments, the specified or pre-determined temperature range is set narrower than the actual temperature that will cause damage to the item being shipped. For example, if an item will melt at 100° F., the upper limit of the specified or pre-determined temperature range can be set at 75° F., or at another temperature which gives a suitable margin before the item is damaged. Thus, if, after an out of range temperature is detected, the temperature of the item continues to rise before the cooling cell 242 is activated, the item will not be damaged as the cooling cell 242 begins removing heat from the container or provides a noticeable or detectable cooling effect.

If the temperature detected in state 304 is within the specified or predetermined range, the process 300 moves to step 305, wherein the process waits a predetermined time before sampling or sensing temperature again. This wait can prevent unnecessary expenditure of limited power resources from the power source 267. After waiting the predetermined amount of time in step 305, the process returns to step 302, wherein the temperature is sensed, and the process 300 begins again. In some embodiments, the process 300 need not include waiting a predetermined time, as in step 305.

If the processing unit 264 determines that the temperature is outside the specified or pre-determined range, or if the rate of change of temperature of the item or the container internals is significant, or is high, in state 304 the process 300 moves to decision state 306 wherein it is determined whether any cooling cells 242 or heating cells 252 have not been actuated. The processing unit 264 can store information regarding the number of available cooling cells 242 and heating cells 252 within the temperature control pack 230. The processing unit 264 can record and increment a count whenever a signal is sent to one of the cooling cells 242 or to one of the heating cells 242. The processing unit 264 can then determine how many unactuated cooling and heating cells, 242, 252 are available. In some embodiments, the switches 248, 258 can record or transmit to the processing unit 264 whenever a current is applied to a cooling cell 242 or a heating cell 252. If all the cooling cells 242 of the cooling unit 240 have been actuated, or if all of the heating cells 252 of the heating unit 250 have been actuated, then the process 300 moves to step 308 and ends. In some embodiments, if it is determined that all the cooling and heating cells 242, 252 have been actuated, the processing unit 264 may cause an alarm to sound or may send a communication via a wireless transmitter indicating that there are no more cooling or heating cells 242, 252 left to actuate, and warning that the contents of the package may be in danger of exceeding the specified or pre-determined temperature range.

The alarm can be an audible alarm and can emanate from the alarm 263. In some embodiments, the communications port 265 may send a signal, such as a Bluetooth, RF, Wi-Fi, cellular, or other type of wireless communication signal which can be received by a carrier or delivery personnel, facility personnel, and the like. The signal may include why the temperature control unit 230 is alarming or what the alarming condition is, for example, temperature out of range, circuitry failure, low battery, final cooling or heating cell 242, 252 actuated, or any other alarm condition. When an alarm signal is received, the distribution network personnel can investigate and or correct the problem. The alarming condition can be stored on a central server of the distribution network for tracking, accountability, trending, and the like.

If there are remaining, unactuated cooling cells 242 and/or heating cells 252, as determined in state 306, the process moves to decision state 310, wherein it is determined whether the sensed temperature is too high, that is, whether the sensed temperature is above an upper set point or limit of the specified or predetermined range.

If the processing unit 264 determines that the temperature is too high in state 310, the process 300 moves to step 312, wherein the processing unit 264 sends a signal to actuate one of the cooling cells 242. The cooling cell 242 can be actuated by the electric signal as described elsewhere herein, and can cool the contents of the container. In some embodiments, the processing unit 264 may store the container temperature received from the temperature sensor 266 as a function of time. The processing unit 264 can calculate a rate of change of temperature. If the rate of change of temperature is high enough that actuation of a single cooling cell 242 would not arrest the heating rate of the container, the processing unit 264 can send a signal to actuate two or more of the cooling cells 242 at the same time or in quick succession.

If the processing unit 264 does not determine that the temperature is too high, the process 300 moves to step 314, wherein the processing unit 264 sends a signal to actuate one of the heating cells 252. If the processing unit 264 determines that the sensed temperature is not too high, this is, in effect, a determination that the temperature is too low, as state 310 was only reached through a determination that the temperature is not within the specified or pre-determined range. One of skill in the art will understand that state 310 could determine whether the sensed temperature is too high without departing from the scope of this application. A person of skill in the art would understand that the process 300, in decision state 310 could determine whether the temperature is too low, and then would take action accordingly.

In some embodiments, the processing unit 264 could determine that the rate of temperature change of the item or container internal temperature exceeds the capacity of one of the cooling or heating cells 242, 252, and could send a signal to actuate two or more of the cooling or heating cells 242, 252 simultaneously or in rapid succession. In some embodiments, The process 300 moves to step 316 wherein the system waits a predetermined period before returning to step 302 and repeating the process. This predetermined wait is sufficiently long to allow the temperature change of one or more of the cooling cells 242 and/or heating cells 252 to affect the temperature within the container before the processing unit 264 determines to actuate additional cooling or heating cells 242, 252. After the predetermined wait period, the process 300 moves to decision state 318 returns to step 302, wherein the process is repeated.

When the container 110 is opened, the act of opening the container may disconnect or sever electrical contacts and deactivate the control circuitry. In some embodiments, a tear strip is torn in order to deactivate the temperature control pack 230. This can occur upon delivery, when the recipient opens the container 110 or removes tear strips that sever electrical connections.

Figure 4:
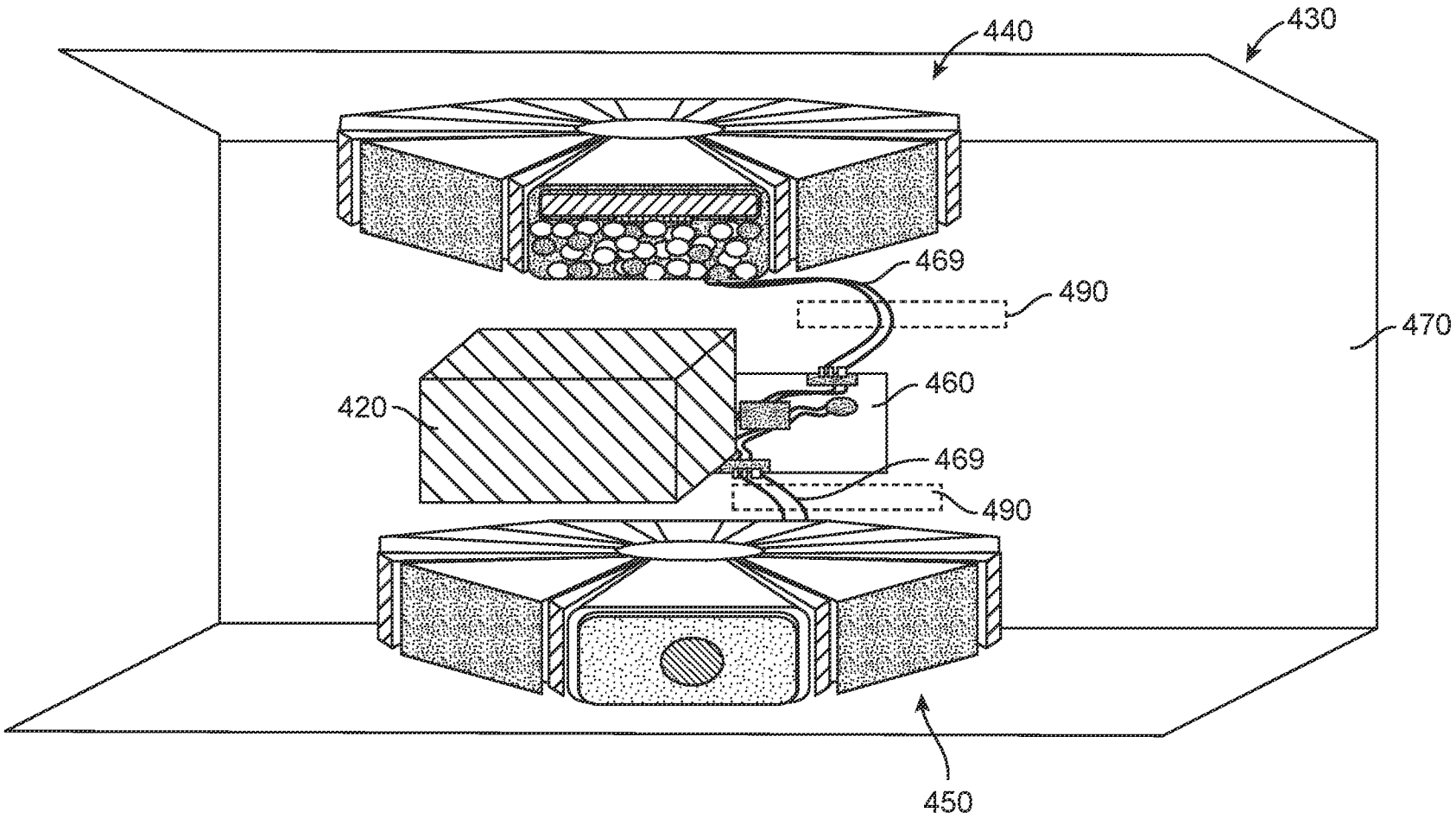
FIG. 4 is a perspective view of an embodiment of a temperature control device insert.

FIG. 4 depicts an embodiment of a temperature control pack 430 on or in an insert insertable into a container. The temperature control pack 430 comprises a cooling unit 440, a heating unit 450, and control circuitry 460. These components can be similar to those described elsewhere herein. The cooling unit 440, the heating unit 450, and control circuitry 460 are attached to an insert 470. The insert 470 can be a cardboard, insulator, foam, or other type of insert shaped and sized to slide into a box or container that will be used to ship an item. The insert can be similar to the components of the shipment system 100 described elsewhere herein. The box or container can be a standard size/shape box as are currently available. In some embodiments, the insert 470 may not include both a cooling unit 440 and a heating unit 450, but may include either a cooling unit 440 or a heating unit 450. In some embodiments, the insert 470 can include two or more cooling units 440 or two or more heating units disposed on the insert 470. The insert 470 will provide structural support and insulation between the item and the container in which the item is being shipped. In some embodiments, the insert 470 can comprise tear-away sides in order to allow access to the item 420, and will comprise one or more tear strips 490 that can be removed to sever leads 469 to break the electrical connection between the cooling and heating units 440, 450 and the control circuitry 460.

The cooling unit 440 is connected to an upper surface of the insert 470, and the heating unit 450 is connected to a lower surface of the heating unit. The control circuitry 460 is shown attached to a side panel, or vertical portion of the insert 470, but this is exemplary only. The control circuitry 460 could be attached at any desired location on the insert 470. The cooling unit 440 and the heating unit 450 are positioned such that an item 420 can be received between the cooling unit 440 and the heating unit 450, as depicted. The cooling unit 440 is shown disposed above the item 420 and the heating unit 450 is shown disposed below the item. When the insert 470 and the item 420 are placed within a container, the item 420 can sit on the heating unit 450 such that the heating unit 450 is in contact with a surface of the item 420, and the cooling unit 440 can be in contact with another surface of the item 420. In some embodiments, the item 420 can sit on a platform similar to those described with regard to FIG. 1 that will maintain the item 420 not in direct contact with either a cooling unit 440 or a heating unit 450. In some embodiments, the heating unit 450 can be disposed above the item and the cooling unit 440 can be disposed below the item.

Figure 5:
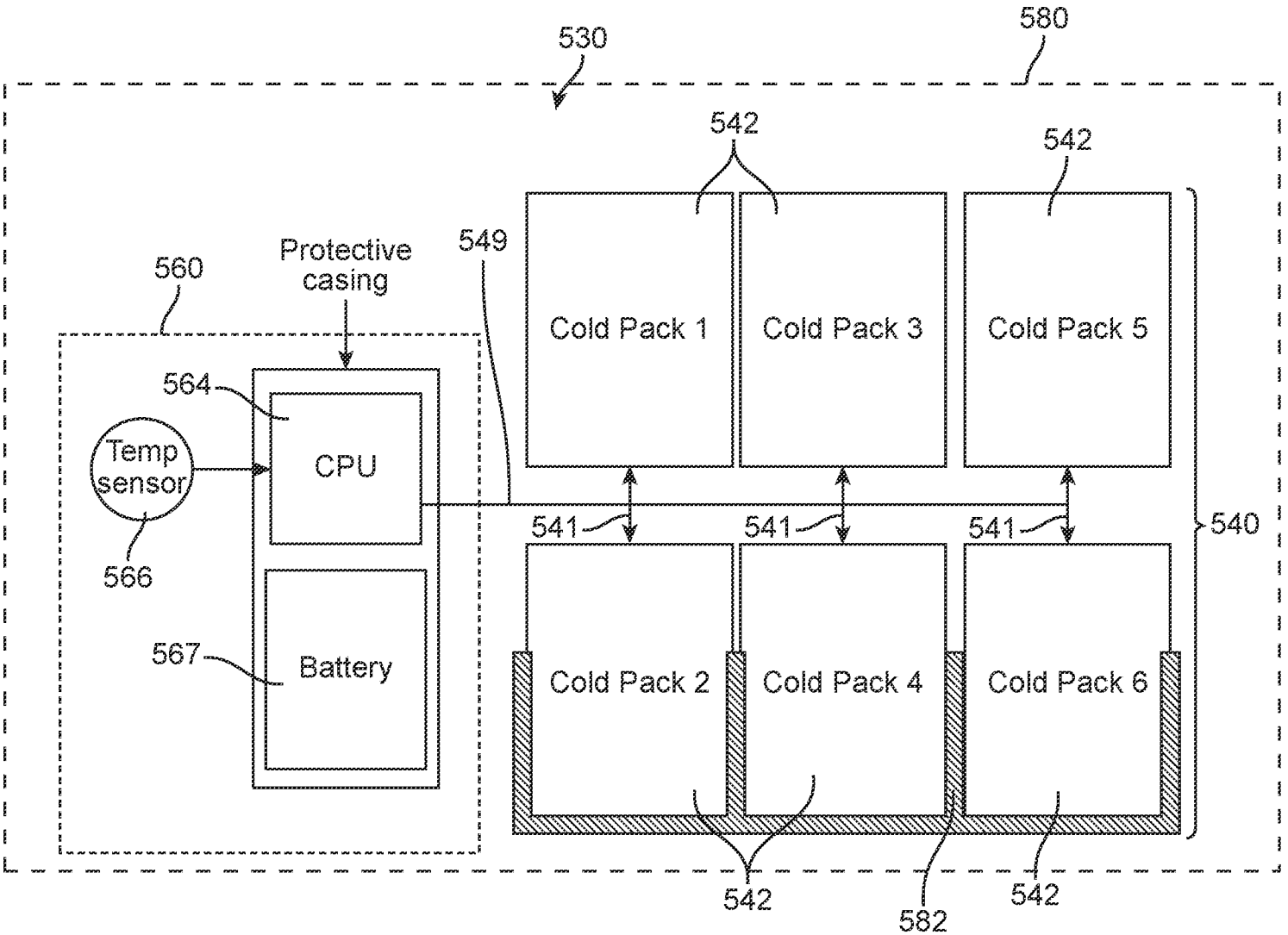
FIG. 5 is a block diagram of an embodiment of a temperature control device arrangement.

FIG. 5 is a block diagram of an embodiment of a temperature control device. The temperature control device 530 is shown attached to a portion of an inner wall 580 of a container (not shown). The temperature control device 530 comprises a cooling unit 540 and control circuitry 560. The control circuitry 560 includes a processing unit 564, a temperature sensor 566, and a power source 567. The control circuitry 560 can operate similar to the control circuitry discussed elsewhere herein. The processing unit 564 can be wired to each of the cooling cells 542 via a set of leads 569 for each cooling cell 542, and can actuate the cooling cells 542 according to temperature signals received from the temperature sensor 566.

The cooling unit 540 comprises a plurality of cooling cells 542. The cooling cells 542 can be similar to those described elsewhere herein. The cooling cells 542 are retained within pockets, frames, holders, or supports 582. The supports 582 are attached to the inner wall 580 and are sized and shaped to receive and releasably retain one or more of the cooling cells 542. In some embodiments, the cooling cells 542 can be easily inserted into and removed from the supports 582.

The cooling cells 542 are in electrical contact with the control circuitry 560 via leads 549. Each of the plurality of cooling cells 542 is connected to an associated lead 549 or set of leads 549 via a node 541. The nodes 541 can be fixed connections, or can be points where the cooling cells 542 are hardwired to the leads 549. In some embodiments, the nodes 541 are contact pads, stabs, button-type connectors, or a similar releasable type of electrical connector. The leads 549 may be fixed in place on the inner wall 580 at specific positions corresponding to the location of each of the plurality of cooling cells 542, for example, in the supports 582. The nodes 541 can be formed on an outer surface of the cooling cells 542. In this way a cooling cell 542 can be inserted into the supports 582, and, by the insertion, can align electrical contacts to make an electrical connection between the node 541 for that cooling cell 542 and the corresponding leads 549.

The arrangement of nodes 541 for connecting the cooling cells 542 to the leads 549, and thus, to the control circuitry 560, allows for a cooling cell 542 to be removed from the cooling unit 540 if it was not actuated during transit of the container or shipping of the item. As an item is transported in a container having a temperature control pack 530, it may not be necessary to actuate each of the plurality of cooling cells 542 in order to maintain the temperature within the container in the specified range. When the container arrives at its destination, the cooling unit 540 may have unused or non-actuated cooling cells 542. The releasable electrical connections of the nodes 541 allows for removal of cooling cells 542 from the cooling unit 540 which were not activated. These unused or non-actuated cooling cells 542 can be inserted into and used in another container having a temperature control pack 530. Similarly, unused cooling and heating packs 242, 252 can be removable from the cooling and heating units 240, 250 and be inserted to another cooling or heating unit 240, 250 and be reused.

The temperature control pack 530 described herein refers only to a cooling unit 540 having cooling cells 542, but one of skill in the art, guided by this disclosure, would understand that the temperature control pack 530 could include a heating unit and heating cells as described elsewhere herein.

The technology is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

The present disclosure refers to processor-implemented steps for processing information in the system. Instructions can be implemented in software, firmware or hardware and include any type of programmed step undertaken by components of the system.

The processors or processing units described herein may be implemented with any combination of general-purpose microprocessors, microcontrollers, digital signal processors (DSPs), field programmable gate arrays (FPGAs), programmable logic devices (PLDs), controllers, state machines, gated logic, discrete hardware components, dedicated hardware finite state machines, or any other suitable entities that may perform calculations or other manipulations of information. The system hub 210 may comprise a processor 212 such as, for example, a microprocessor, such as a Pentium® processor, a Pentium® Pro processor, a 8051 processor, a MIPS® processor, a Power PC® processor, an Alpha® processor, a microcontroller, an Intel CORE i7®, i5®, or i3® processor, an AMD Phenom®, A-series®, or FX® processor, or the like. The processors 212 and 305 typically have conventional address lines, conventional data lines, and one or more conventional control lines.

The system may be used in connection with various operating systems such as Linux®, UNIX®, MacOS®, or Microsoft Windows®.

The system control may be written in any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system control may also be written using interpreted languages such as Perl, Python, or Ruby.

Those of skill will further recognize that the various illustrative logical blocks, modules, circuits, and algorithm steps described in connection with the embodiments disclosed herein may be implemented as electronic hardware, software stored on a computer readable medium and executable by a processor, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such embodiment decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

If implemented in software, the functions may be stored on or transmitted over as one or more instructions or code on a computer-readable medium. The steps of a method or algorithm disclosed herein may be implemented in a processor-executable software module which may reside on a computer-readable medium. Memory Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A method for controlling a climate controlled shipping system comprising:

receiving an item within an insulated container;

setting a specified temperature range for the insulated container based on one or more item characteristics;

receiving, in a server:

an origin location of the item, an intended destination of the item, and a route to be traveled in transporting the item from the origin location to the intended destination;

sensing, by a temperature sensor disposed in the insulated container at a first location along the route to be traveled, a temperature of an inner volume of the insulated container;

identifying, an outside temperature at a second location along the route to be traveled, wherein the second location is between the first location and the intended destination;

activating, by a processor, one or more temperature control units in the insulated container at the first location based on the sensed temperature at the first location and the outside temperature at the second location; and maintaining the temperature of the insulated container within the specified temperature range by selectively activating the one or more temperature control units.

2. The method of claim 1, wherein activating the one or more temperature control units further comprises determining a sequence of trigger points based on the temperature sensed by the temperature sensor and the route to be traveled.

3. The method of claim 2, wherein the sequence of trigger points corresponds to location points of a predetermined route.

4. The method of claim 2, wherein the sequence of trigger points comprises trigger points based on the temperature of the insulated container at a current location point.

5. The method of claim 2, wherein activating the one or more temperature control units further comprises sending signals to activate a plurality of cooling packs based on the determined sequence of trigger points.

6. The method of claim 1, wherein the received route to be traveled comprises one or more location points.

7. The method of claim 1, wherein activating the one or more temperature control units comprises switching a plurality of cooling packs on when the temperature sensed falls outside the specified temperature range of the item.

8. The method of claim 1 further comprises broadcasting by the processor of the one or more temperature control units, the sensed temperature to the server.

9. The method of claim 1 further comprises:

determining a new specified temperature range while the item is in transit based on the route to be traveled; and adjusting the specified temperature range for the insulated container using a remote computing device in communication with the server based on the new specified temperature range of the item.

10. The method of claim 9, wherein adjusting the specified temperature range for the insulated container comprises sending, by the server, the new specified temperature range to the processor.

11. The method of claim 2, wherein activating the one or more temperature control units comprises sending signals to a plurality of heating packs based on the determined sequence of trigger points.

12. The method of claim 1, wherein activating temperature control units further comprises activating individual temperature control units of a plurality of temperature control units based on the specified temperature range of the insulated container.

13. A method for controlling a climate controlled system comprising:

receiving an insulated container for shipping an item, the insulated container having a temperature control unit in communication with a remote computing device disposed therein;

determining a specified temperature range based on one or more item characteristics of the item;

setting, in a user interface, by a sender of the item, the specified temperature range for the insulated container;

receiving in the user interface a route to be traveled in transporting the item, the route comprising an intended destination of the item;

sensing, by a temperature sensor disposed in the insulated container at a first location along the route to be traveled, a temperature of an inner volume of the insulated container;

receiving, in the temperature control unit, from the remote computing device, an updated temperature range based on an outside temperature of a second location along the route to be traveled using the remote computing device after transportation of the item has begun, wherein the second location is between the first location and the intended destination; and based upon the received updated temperature range, adjusting, by the temperature control unit, the specified temperature range of the insulated container at the first location.

14. The method of claim 13, wherein the one or more item characteristics includes item composition.

15. The method of claim 13 further comprises adjusting the set specified temperature by evaluating a temperature and conditions at a new location of the item based on a destination.

16. The method of claim 13, wherein adjusting the specified temperature range for the insulated container further comprises adjusting the specified temperature range based on conditions along the route to be traveled.

17. The method of claim 13 further comprises adjusting the specified temperature range using the remote computing device.

18. The method of claim 13, further comprising receiving in the user interface an origin location of the item.

19. The method of claim 13, further comprising receiving in the user interface a destination for the item.

* * * * *